US007820933B2

(12) United States Patent
Heiermeier et al.

(10) Patent No.: US 7,820,933 B2
(45) Date of Patent: Oct. 26, 2010

(54) PUFFER CIRCUIT BREAKER WITH AN OVERPRESSURE VALVE

(75) Inventors: Helmut Heiermeier, Wutöschingen (DE); Kurt Kammerl, Griessen (DE); Timo Kehr, Birrhard (CH); Stephan Grob, Baden (CH)

(73) Assignee: ABB Technology AG, Zurich (CH)

( * ) Notice: Subject to any disclaimer, the term of this patent is extended or adjusted under 35 U.S.C. 154(b) by 467 days.

(21) Appl. No.: 11/798,611

(22) Filed: May 15, 2007

(65) Prior Publication Data

US 2007/0272658 A1 Nov. 29, 2007

(30) Foreign Application Priority Data

May 29, 2006 (EP) ..... 06405236

(51) Int. Cl.
*H01H 33/88* (2006.01)

(52) U.S. Cl. ..... 218/60; 218/57; 218/66

(58) Field of Classification Search ..... 218/48–54, 218/57, 59, 60–66, 71–74
See application file for complete search history.

(56) References Cited

U.S. PATENT DOCUMENTS 5,589,673 A * 12/1996 Lehmann et al. ..... 218/66
6,207,918 B1 * 3/2001 Lorenz et al. ..... 218/59

FOREIGN PATENT DOCUMENTS

EP 0 519 343 A1 12/1992
EP 0 676 783 A2 10/1995
EP 1 079 404 A 2/2001
EP 1 235 243 A 8/2002

OTHER PUBLICATIONS

European Search Report.

* cited by examiner

*Primary Examiner*—Renee Luebke
*Assistant Examiner*—Marina Fishman
(74) *Attorney, Agent, or Firm*—Buchanan Ingersoll & Rooney PC

(57) ABSTRACT

A circuit breaker comprises a puffer volume (9) and at least one overpressure valve (16) for discharging gas from the puffer volume (9), if the pressure therein exceeds a given threshold. The overpressure valve (16) is formed by a piston (17) and a spring (19) as well as by a cavity (18) in the stationary support body (10) of the moveable contact assembly (2). The overpressure valve (16) is of compact and simple design, has low hysteresis and large cross-section.

19 Claims, 2 Drawing Sheets

PUFFER CIRCUIT BREAKER WITH AN OVERPRESSURE VALVE

TECHNICAL FIELD

The invention relates to a puffer circuit breaker having an overpressure valve.

Puffer circuit breakers generate a high pressure buildup in their puffer volume at very high current levels. The pressure depends on contact speed, puffer volume, current asymmetry and contact system dimension. While it is desirable to achieve a certain pressure level in the circuit breaker, a too high pressure is not desired since the force generated by the pressure acts against the contact movement, reduces the contact distance in the moment of interruption and/or makes it necessary to use a stronger breaker drive.

BACKGROUND

It has therefore been known to use overpressure valves for limiting the pressure in the puffer volume. However, such overpressure valves, which are mounted as separate units to the support of the movable contact assembly, are expensive. In addition, they require space or, if they are of small design, they have small diameters only, which reduces the gas flow therethrough.

SUMMARY OF THE INVENTION

Hence, the object of the present invention is to provide a puffer circuit breaker that addresses these problems.

Accordingly, the support comprises an integrated valve cavity for receiving the spring of the valve. Furthermore, it comprises an integrated valve inlet opening that opens into the puffer volume and that can be closed by the piston of the valve.

Since the valve cavity and inlet opening are integrated into the support, the support itself forms the walls of the same. In contrast to this, the conventional design uses a separate valve unit forming the valve cavity and the valve inlet opening, which valve unit has, in turn, to be held by the support, e.g. in a threading, which requires more space.

Advantageously, the support comprises an integral, single-piece body surrounding the driving rod of the moveable contact assembly and the valve cavity and valve inlet opening are integrated therein.

BRIEF DESCRIPTION OF THE DRAWINGS

Further embodiments, advantages and applications of the invention are disclosed in the dependent claims as well as in the following description, which makes reference to the figures. These show:

EMBODIMENTS OF THE INVENTION

Figure 1:
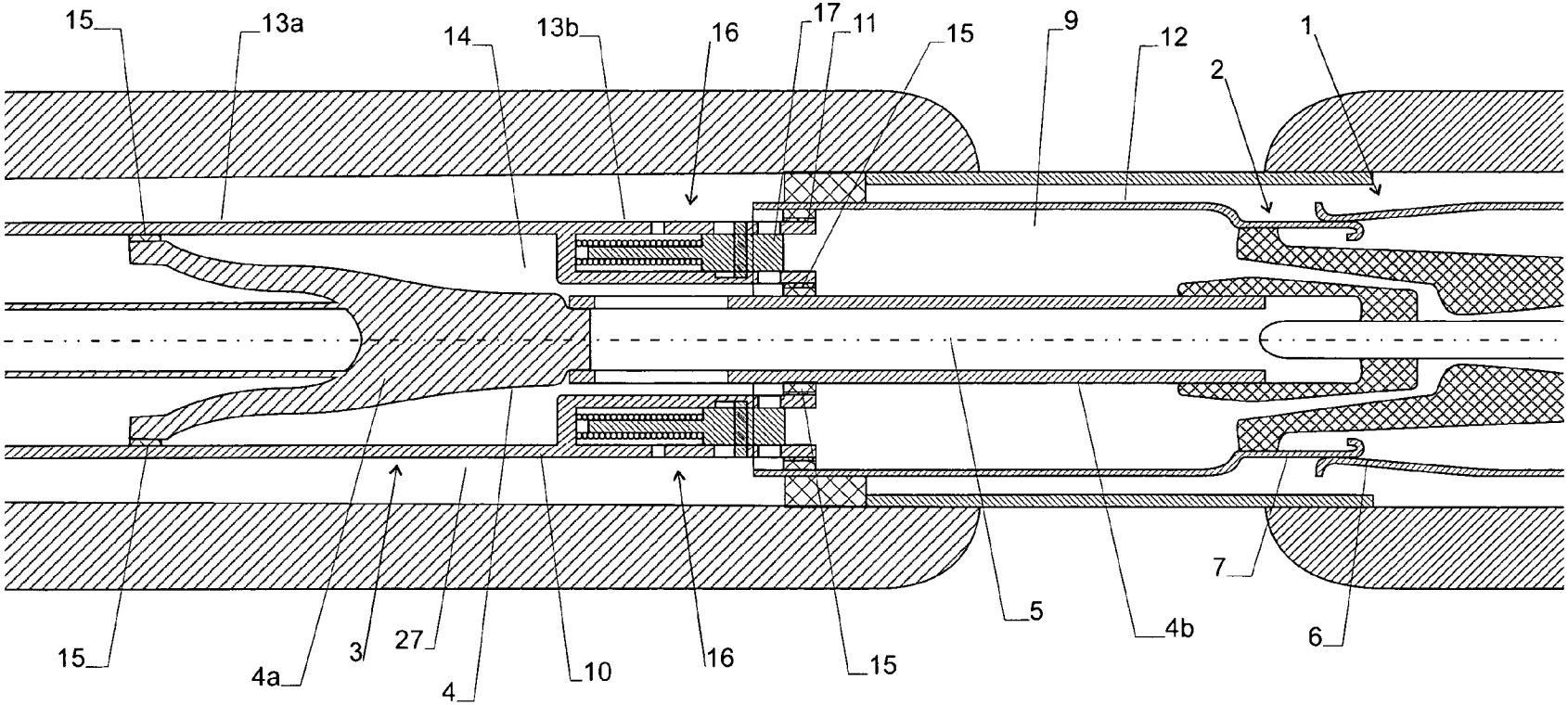
FIG. 1 is a sectional view of a circuit breaker.

The circuit breaker of FIG. 1 is a high voltage circuit breaker designed for voltages of e.g. at least 72.5 kV. It comprises a stationary contact assembly 1 and a moveable contact assembly 2. Moveable contact assembly 2 is moveably held in a stationary support 3. A rod 4 comprising a base member 4*a* and a tube 4*b* is connected to moveable contact assembly 2 for moving the same along a direction of displacement that generally coincides with the longitudinal axis 5 of the circuit breaker.

Stationary contact assembly 1 comprises a series of first, stationary contacts 6 arranged to contact a mating second contact 7 of moveable contact assembly 2. When the circuit breaker is operated, second contact 7 disengages from the first contacts 6 and an arc is formed in an arc volume. The pressure generated in the arc volume feeds back, in part, into a puffer volume 9 (also called "buffer volume") formed between moveable contact assembly 2 and support 3. Puffer volume 9 is formed between a front plate 11 of support 3 and a cylinder housing 12 of moveable contact assembly 2. Front plate 11 is slideably arranged in the cylinder housing 12.

Support 3 comprises an integral tubular body 10 made from a single piece of cast metal. Body 10 is of tubular, approximately cylindrical shape and extends around rod 4. It forms front plate 11 at one end, a cylindrical base section 13*a* at the opposite end, and a valve section 13*b* located between front plate 11 and base section 13*a*. Rod 4 is located in an axial cavity 14 of body 3 and guided therein by frictional bearings 15.

Overpressure valves 16 are mounted in valve section 13*b* of the integral tubular body 10 of support 3. In the present embodiment, a total of four such overpressure valves 16 are provided in two pairs at angular positions of e.g. 0°, 45° and 180°, 225°. Two of these overpressure valves 16 can be seen in FIG. 1. The purpose of these valves 16 is to release gas from puffer volume 9, if the pressure therein exceeds a given threshold of e.g. 45 bar.

Figure 2:
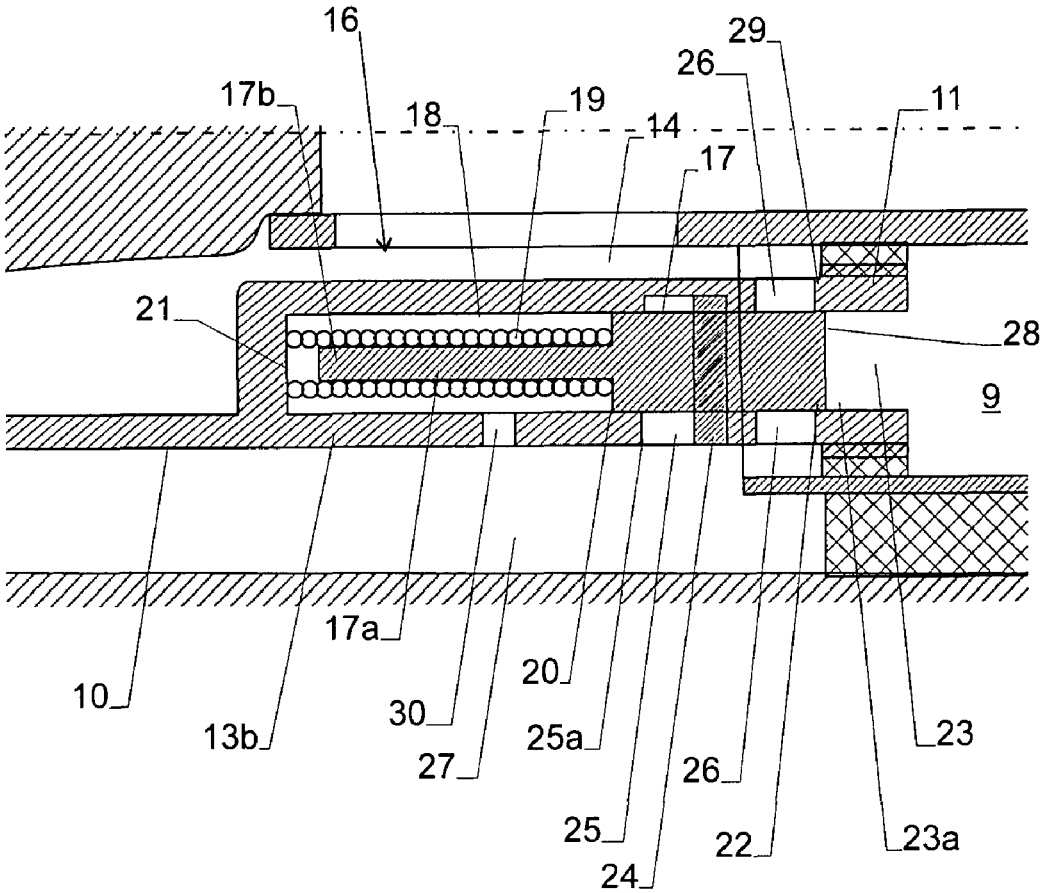
FIG. 2 is an enlarged section of FIG. 1 showing a single overpressure valve.

As can best be seen in FIG. 2, each overpressure valve 16 comprises a moveable piston 17 with a rear end 17*a* extending into a valve cavity 18 formed by a bore in valve section 13*b* of the tubular body 10. A valve spring 19 surrounds rear end 17*a* of piston 17 and extends, in a slightly compressed state, between a shoulder 20 of piston 17 and a rear wall 21 of valve cavity 18.

A head 22 at the forward end of piston 17 extends into a valve inlet opening 23. Valve inlet opening 23 is formed by a bore through front plate 11 of support 3.

A stop member 24 formed by a screw projects laterally from piston 17 into an elongate hole or recess 25. The stroke could also be limited by any other means, e.g. by a centered screw or a Seeger-ring.

The tubular body 10 further comprises at least one window 26 forming a duct from a region between valve cavity 18 and valve inlet opening 23 to an exhaust space of the circuit breaker. In the embodiment shown here, the window 26 opens into the exhaust space 27 located outside the tubular body 10 as well as into the axial cavity 14, with the axial cavity 14 being connected to the exhaust space 27 by means of large openings (not visible in the figures) in the tubular body 10.

In operation in the absence of overpressure in puffer volume 9, spring 19 urges piston 17 forwards such that its head 22 extends into the valve inlet opening 23, thereby closing the valve 16. When the pressure in puffer volume 9 exceeds the threshold pressure of the valve 16, the piston 17 is pushed backwards to release the valve inlet opening 23, thereby opening the valve 16 such that gas from puffer volume 9 can pass through window 26. The maximum displacement of piston 17 is limited by the stop member 24 abutting against a rear end 25*a* of the hole or recess 25 or by the rear end 17*a* of the piston 17 abutting against the rear wall 21 of the valve cavity 18. This limitation prevents an excessive, potentially damaging compression of the spring 19 even if the pressure in the puffer volume 9 is very high.

Piston 17 is displaceable along a direction of displacement parallel to longitudinal axis 5 of the circuit breaker (see FIG. 1). Its head 22 has a constant cross-section, i.e. the cross-section perpendicular to the direction of displacement does not change along the direction of displacement. Similarly, at least an end section 23*a* of the valve inlet opening 23 has a constant cross-section. Both said cross-sections match for forming a seal when the head 22 extends into the end section 23*a*. The head 22 ends in an end surface 28 of piston 17 that extends perpendicular to said direction of displacement. Similarly, the end section 23*a* of valve inlet opening 23 ends in a surface 29 of support 3 that extends perpendicular to said direction of displacement. All these measures contribute, individually and in combination, to reducing the hysteresis of the overpressure valve 16.

As can be seen e.g. in FIG. 2, piston 17 closes a forward end of the cavity 18. In order to allow a gas exchange between the cavity 18 and its surroundings during a movement of piston 17, a duct 30 connects the valve cavity 18 to the exhaust space 27 (or to any other volume much larger than the valve cavity 18). Duct 30 is dimensioned such that the gas passing therethrough experiences sufficient friction for damping the movement of piston 17 in cavity 18.

The overpressure valve 16 according to the design shown here is very compact. Hence, it is inherently fast. To increase its speed even further, piston 17 is made of aluminum, thereby reducing its weight.

Even though the overpressure valve 16 is very compact, it can open a channel of comparatively large cross-section, thereby depleting the puffer volume 9 quickly. To further expedite such a depletion, a window 26 opens towards an axial cavity 14 and a window 26, preferably the same window 26, opens towards an exhaust space 27. Preferably, the windows 26 are large, each one connecting two neighboring overpressure valves 16, which again increases the available cross-section of the passage.

The design of the overpressure valve 16 shown here is simple and compact. Since it is an integral part of support 3, the costs for its assembly are low. Still it reacts quickly, has low hysteresis, and is able to deplete the puffer volume 9 quickly.

LIST OF REFERENCE NUMBERS

1: stationary contact assembly
2: moveable contact assembly,
3: support
4: rod
4*a*: base member
4*b*: tube
5: longitudinal axis
6: first contacts
7: second contact
9: puffer volume
10: body
11: front plate
12: cylinder housing
13*a*: base section
13*b*: valve section
14: axial cavity
15: frictional bearings
16: overpressure valves
17: piston
17*a*: rear end of piston 17
18: valve cavity
19: valve spring
20: shoulder
21: rear wall of valve cavity 18
22: head of piston 17
23: valve inlet opening
23*a*: end section of valve inlet opening
24: stop member
25: hole or recess
26: window
27: exhaust space
28: end surface
29: surface
30: duct

The invention claimed is:

1. A puffer circuit breaker comprising:

a stationary contact assembly and a moveable contact assembly;

a rod connected to said moveable contact assembly for actuating said moveable contact assembly;

a support movably holding said moveable contact assembly and being arranged around said rod;

a puffer volume formed between a front plate of said support and a cylinder housing of said moveable contact assembly, wherein the front plate is slidably arranged in the cylinder housing;

at least one overpressure valve arranged at said support for releasing an overpressure in said puffer volume, wherein said overpressure valve comprises a moveable piston and a spring, wherein said support comprises an integrated valve cavity for receiving said spring and an integrated valve inlet opening into said puffer volume and being closeable by said piston, and wherein said moveable piston has a head that extends into an end-section of said valve inlet opening along a direction of displacement to form a seal.

2. The circuit breaker of claim 1, wherein said support comprises an integral tubular body arranged around said rod, wherein said valve cavity and said valve inlet opening are formed by said tubular body.

3. The circuit breaker of claim 2, wherein said tubular body comprises at least one window forming a duct from a region between said valve cavity and said valve inlet opening to an exhaust space of said puffer circuit breaker.

4. The circuit breaker of claim 3 comprising at least two neighboring overpressure valves sharing a common window.

5. The circuit breaker of claim 3, wherein said window opens into a space located outside said tubular body as well as into an axial cavity inside said tubular body.

6. The circuit breaker of claim 1, wherein said head has a constant cross-section along said direction of displacement of said piston, wherein said end section also has a constant cross-section along said direction of displacement, and wherein the cross-section of said end section matches the cross-section of said head for forming the seal when said head extends into said end section.

7. The circuit breaker of claim 6, wherein said end section ends in a surface of said support extending perpendicular to said direction of displacement.

8. The circuit breaker of claim 6, wherein said head ends in a surface extending perpendicular to said direction of displacement.

9. The circuit breaker of claim 1, wherein said piston extends into said valve cavity and wherein said support comprises at least one duct connecting said valve cavity to a volume larger than said valve cavity for releasing an overpressure in said valve cavity upon a displacement of said piston and for damping a motion of said piston.

10. The circuit breaker of claim 1, comprising a stop member laterally projecting from said piston for limiting a longitudinal displacement of said piston.

11. The circuit breaker of claim 10 wherein said support comprises a recess or opening adjacent to said piston and wherein said stop member extends into said recess or opening.

12. The circuit breaker of claim 1, wherein said piston is formed at least in part of aluminum.

13. The circuit breaker of claim 4, wherein said window opens into a space located outside said tubular body as well as into an axial cavity inside said tubular body.

14. The circuit breaker of claim 5, wherein said valve piston has a head that has a constant cross-section along a direction of displacement of said piston and wherein said head is positioned to extend into an end section of said inlet opening, wherein said end section also has a constant cross-section along said direction of displacement, wherein the cross-section of said end section matches the cross-section of said head for forming a seal when said head extends into said end section.

15. The circuit breaker of claim 7, wherein said head ends in a surface extending perpendicular to said direction of displacement.

16. The circuit breaker of claim 8, wherein said piston extends into said valve cavity and wherein said support comprises at least one duct connecting said valve cavity to a volume larger than said valve cavity for releasing an overpressure in said valve cavity upon a displacement of said piston and for damping a motion of said piston.

17. The circuit breaker of claim 9, comprising a stop member laterally projecting from said piston for limiting a longitudinal displacement of said piston.

18. The circuit breaker of claim 11, wherein said piston is formed at least in part of aluminum.

19. A circuit breaker comprising:

a stationary contact assembly and a moveable contact assembly;

a rod connected to said moveable contact assembly for actuating said moveable contact assembly;

a support movably holding said moveable contact assembly and being arranged around said rod;

a puffer volume formed between said support and said moveable contact assembly, and at least one overpressure valve arranged at said support, wherein said overpressure valve comprises a moveable piston and a spring, wherein said support comprises an integrated valve cavity and an integrated valve inlet opening closeable by said piston, and wherein said moveable piston has a head that extends into an end-section of said valve inlet opening along a direction of displacement to form a seal.

* * * * *